US006872092B2

(12) United States Patent
Oka

(10) Patent No.: US 6,872,092 B2
(45) Date of Patent: Mar. 29, 2005

(54) WATERPROOF CONNECTOR WITH WATERPROOF RIB FOR SEALED ENGAGEMENT WITH A RUBBER PLUG

(75) Inventor: Hiroyuki Oka, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/600,860

(22) Filed: Jun. 20, 2003

(65) Prior Publication Data

US 2004/0029442 A1 Feb. 12, 2004

(30) Foreign Application Priority Data

Jul. 8, 2002 (JP) ..... 2002-198224

(51) Int. Cl.[7] ..... H01R 13/40
(52) U.S. Cl. ..... 439/587; 439/275
(58) Field of Search ..... 439/588–589, 439/275–276, 587

(56) References Cited

U.S. PATENT DOCUMENTS 5,145,410 A * 9/1992 Maejima et al. ..... 439/587
5,538,441 A * 7/1996 Paolucci et al. ..... 439/589
5,634,807 A * 6/1997 Saito ..... 439/275
5,871,373 A 2/1999 Pacini et al. ..... 439/587
6,095,860 A * 8/2000 Gehrke et al. ..... 439/587
6,116,938 A * 9/2000 Myer et al. ..... 439/353
6,341,983 B1 * 1/2002 Crawford et al. ..... 439/587
6,722,922 B2 * 4/2004 Cykon et al. ..... 439/587

* cited by examiner

*Primary Examiner*—Hae Moon Hyeon
(74) *Attorney, Agent, or Firm*—Gerald E. Hespos; Anthony J. Casella

(57) ABSTRACT

A rear open end of each cavity (12) is formed on a contact surface (13A) of a rubber plug accommodation part (13) disposed rearward from the connector housing (11). Inner-side waterproof ribs (14) project rearward from the periphery of the contact surface (13A) to surround the rear open ends. A rubber plug (30) is held inside the rubber plug accommodation part (13) by a rubber plug hold-down member (40) mounted on the waterproof connector (11) rearward of the rubber plug (30). Thus, the rubber plug hold-down member (40) presses the rubber plug (30) forward against the contact surface (13A). The inner-side waterproof rib (14) prevents water from penetrating into the cavity (12) from the gap between the contact surface (13A) and a front surface of the rubber plug (30) through a peripheral surface of the rubber plug (30).

7 Claims, 9 Drawing Sheets

WATERPROOF CONNECTOR WITH WATERPROOF RIB FOR SEALED ENGAGEMENT WITH A RUBBER PLUG

BACKGROUND OF THE INVENTION

1. Field of the Invention

The present invention relates to a waterproof connector.

2. Description of the Related Art

U.S. Pat. No. 5,871,373 and FIG. 9 herein disclose a multi-polar plug hold-down member. With reference to FIG. 9, a waterproof connector 1 has a housing 2, and terminal fittings 3 are accommodated respectively in cavities 4 arranged inside the housing 2. A rubber plug 5 is fit in a rubber plug accommodation hole 6 on the rear surface of the housing 2 to prevent water from penetrating into the cavities 4. A rubber plug hold-down member 7 is disposed in the rear of the rubber plug 5 and holds the rubber plug 5. A waterproof seal is provided in the waterproof connector 1 by bringing the rubber plug 5 into close contact with a sealing surface 8, which is the inner peripheral surface of the rubber plug accommodation hole 6.

The housing 2 may have to be large to multi-polarize the waterproof connector 1. In this situation, the width of the rubber plug accommodation hole 6 becomes large, and the sealing surface 8 becomes long. Thus the sealing surface 8 flexes when the waterproof connector 1 is manufactured. As a result, there is a possibility that waterproofness is not obtained at the gap between the rubber plug 5 and the sealing surface 8.

The present invention has been made in view of the above-described situation. Accordingly, it is an object of the present invention to provide a waterproof connector having improved waterproofness.

SUMMARY OF THE INVENTION

The invention is directed to a waterproof connector with a connector housing that has opposite front and rear end surfaces and a plurality of cavities that extend through the housing from the front end surface to the rear end surface. Terminal fittings connected to ends of electric wires can be inserted into the cavities. The waterproof connector further includes a rubber plug having through-holes at positions corresponding to the respective cavities. The electric wires are penetrated through the through-holes so that the rubber plug is held in close contact with the wires. A rubber plug hold-down member presses the rubber plug against a rear surface of the connector housing and has a plurality of open portions through which the electric wires can be inserted. In this construction, inner-side waterproof ribs project from the rear surface of the connector housing or a front surface of the rubber plug so that the inner-side waterproof ribs are pressed against the front surface of the rubber plug or the rear surface of the connector housing when the rubber plug is pressed against the rear surface of the connector housing. As a result, a water penetration path passing inwards through a side or peripheral portion of the rubber plug and reaching the rear open ends of the cavities can be cut off.

Preferably, outer-side waterproof ribs project from a rear surface of the rubber plug or a front surface of the rubber plug hold-down member so that the outer-side waterproof ribs are pressed against the rear surface of the rubber plug or the front surface of the rubber-plug hold down member, when the rubber plug is pressed against the rear surface of the connector housing. Thus, a water penetration path from the open portions of the rubber plug hold-down member to the side or peripheral portion of the rubber plug can be cut off.

The inner-side waterproof ribs and/or the outer-side waterproof ribs may surround a region corresponding to the rear open ends of the cavities collectively. Alternatively, the inner-side waterproof ribs and/or the outer-side waterproof ribs may surround regions corresponding to the separate rear open ends, respectively.

The rear open ends of the cavities preferably are formed on a rear surface of the connector housing to form a rubber plug accommodation part capable of accommodating the rubber plug. Seal lips capable of water-tightly contacting an inner side or inner peripheral surface of the rubber plug accommodation part are formed on a side or peripheral surface of the rubber plug.

According to the above-described construction of the present invention, it is possible to cut off the water penetration path passing inwards through the side or peripheral portion of the rubber plug and reaching the rear open ends of the cavities and prevent water from penetrating into the cavities by pressing the inner-side waterproof ribs between the rear surface of the connector housing and the front surface of the rubber plug.

There is a possibility, as described above, that the connector flexes due to multi-polarization and thus a surface of the connector housing that contacts the side or peripheral surface of the rubber plug is waterproofed insufficiently. However, it is possible to prevent the flexure of the connector from affecting the waterproofnsss of the waterproof connector by waterproofing the gap between rear surface of the connector housing and the front surface of the rubber plug.

Further it is possible to cut off the water penetration path ranging from the open portions formed on the rubber plug hold-down member to the side portion or peripheral portion of the rubber plug by pressing the outer-side waterproof ribs between the rear surface of the rubber plug and the front surface of the rubber plug hold-down member. Thus, it is possible to prevent water from penetrating into the cavities from the open portions of the rubber plug hold-down member to the rear open ends of the cavities through the side or peripheral portion of the rubber plug. Since waterproofness can be accomplished at the rear surface side of the rubber plug, the waterproofness of the waterproof connector can be improved.

The waterproof ribs are disposed to surround the region corresponding to the rear open ends of the cavities collectively or individually. Therefore it is possible to waterproof the cavities collectively or individually.

Since waterproof seal can be accomplished on the side or peripheral surface of the rubber plug, the waterproofness of the waterproof connector can be improved to a higher extent.

DETAILED DESCRIPTION OF THE PREFERRED EMBODIMENTS

A waterproof connector according to a first embodiment of the present invention is identified by the numeral 10 in FIGS. 1 through 4. The waterproof connector 10 includes a connector housing 11 capable of fitting on an unshown mating connector. In the description made hereinafter, the front side means the right inward side in FIG. 1.

Figure 1:
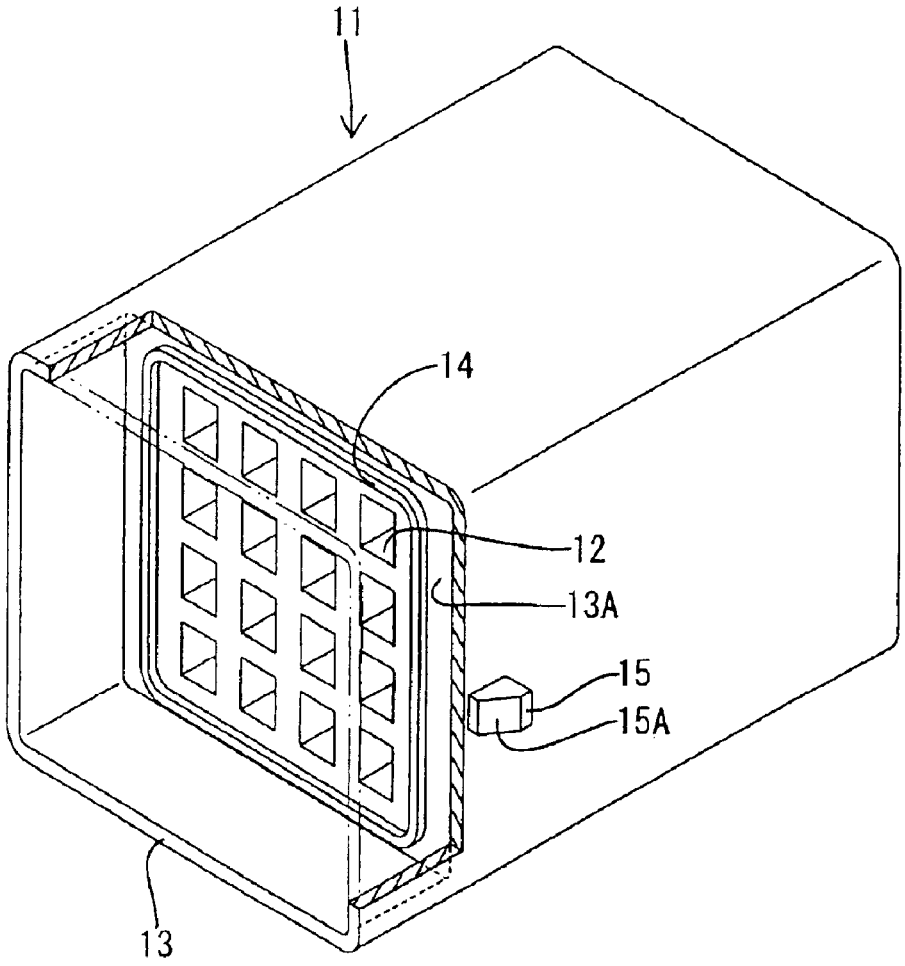
FIG. 1 is a partly cut-away perspective view showing a connector housing of a waterproof connector according to a first embodiment of the present invention.
Figure 2:
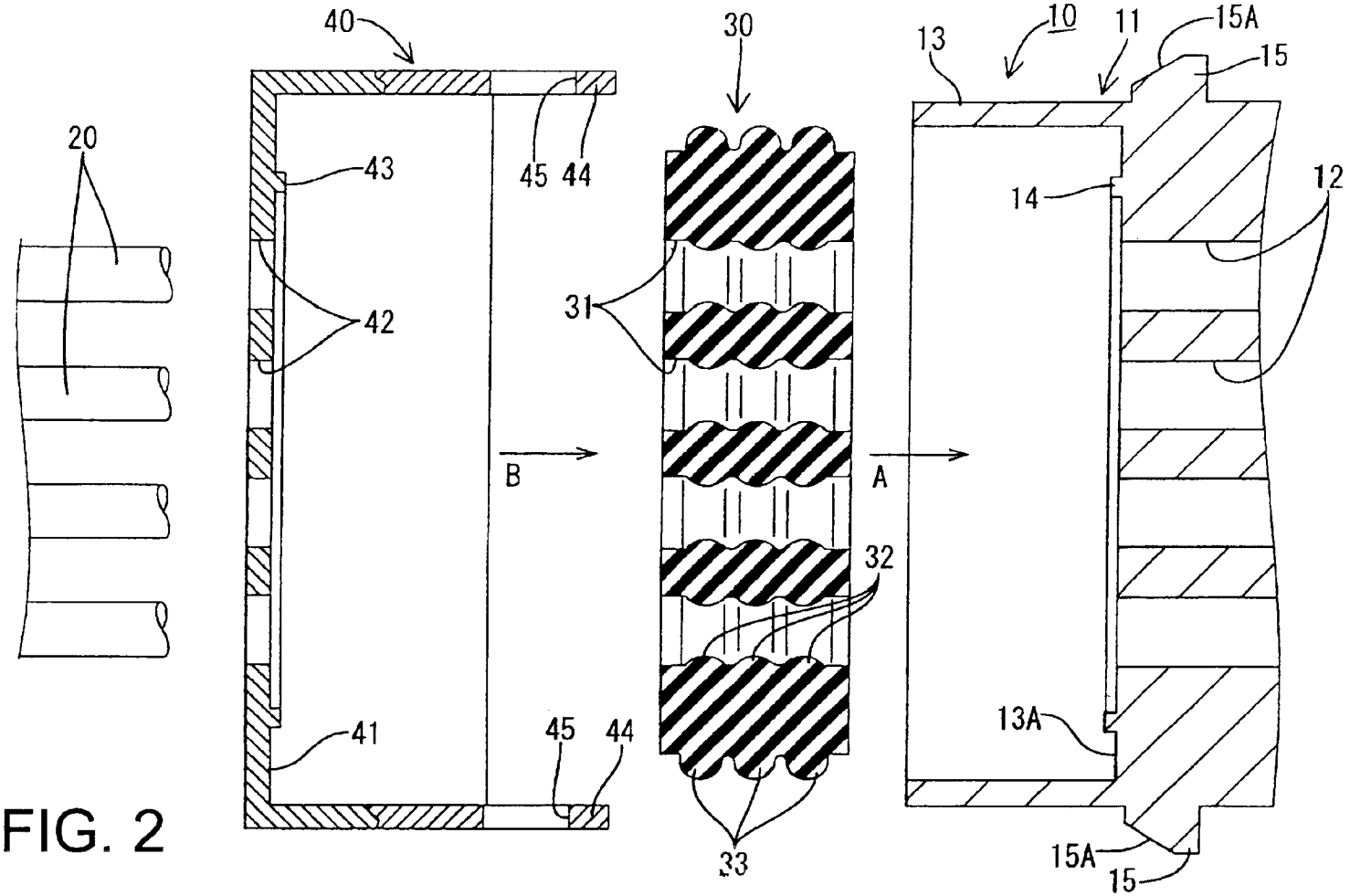
FIG. 2 is a side view partly in section before the waterproof connector is assembled.
Figure 4:
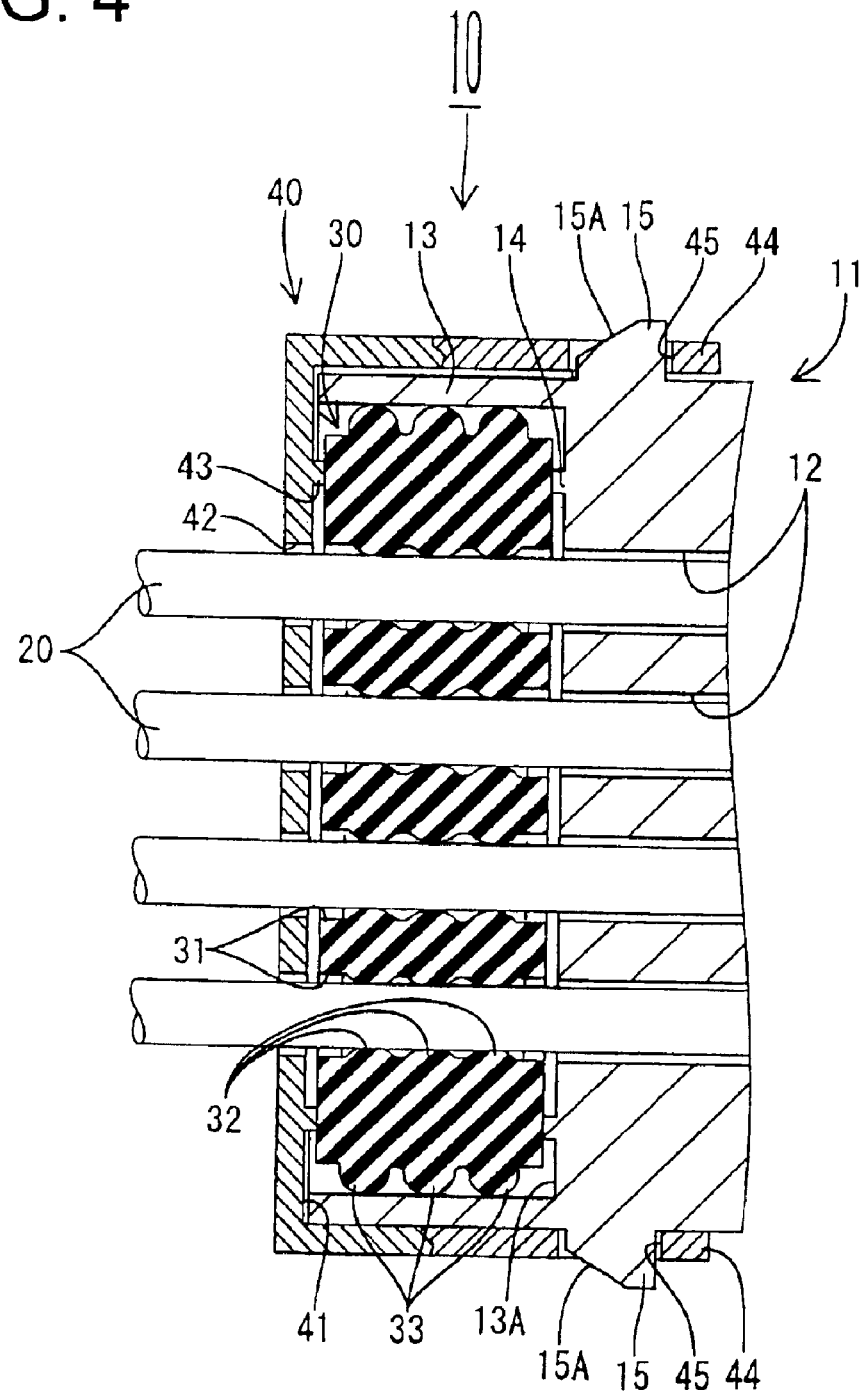
FIG. 4 is a side view partly in section showing a state in which the waterproof connector has been assembled.
Figure 5:
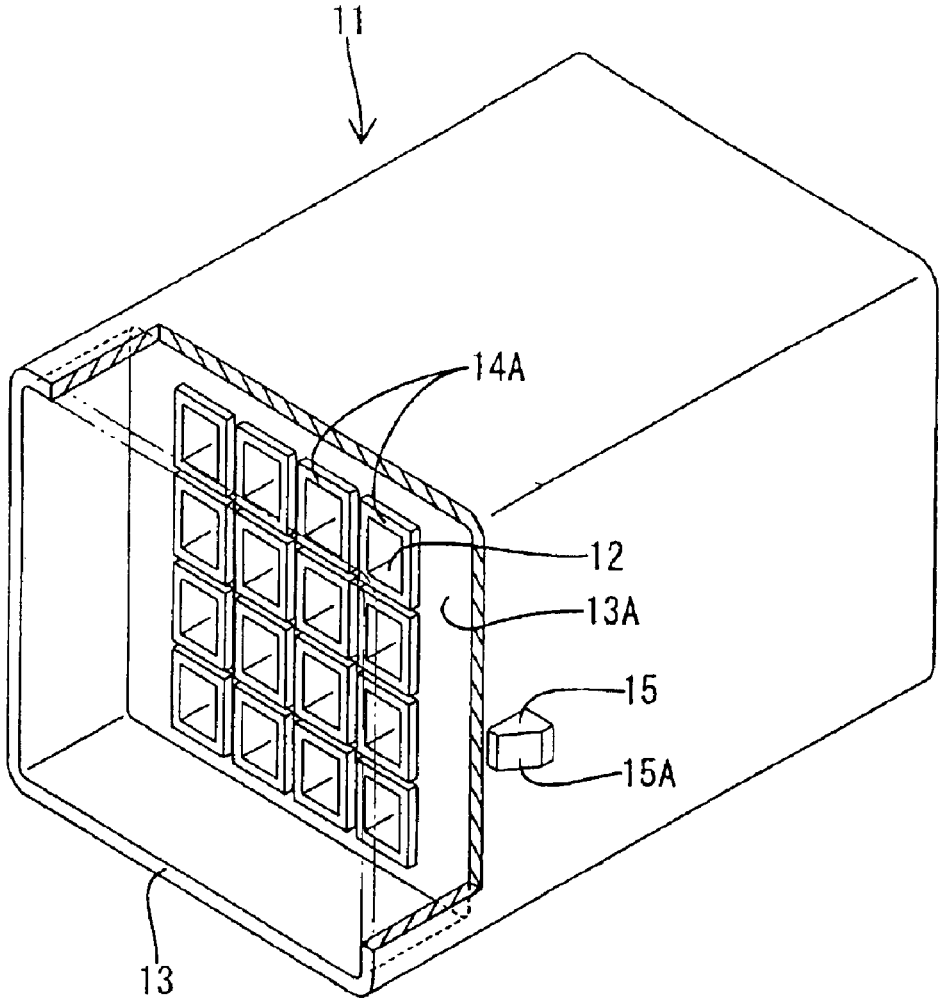
FIG. 5 is a partly cut-away perspective view showing a connector housing of a waterproof connector according to a second embodiment of the present invention.
Figure 6:
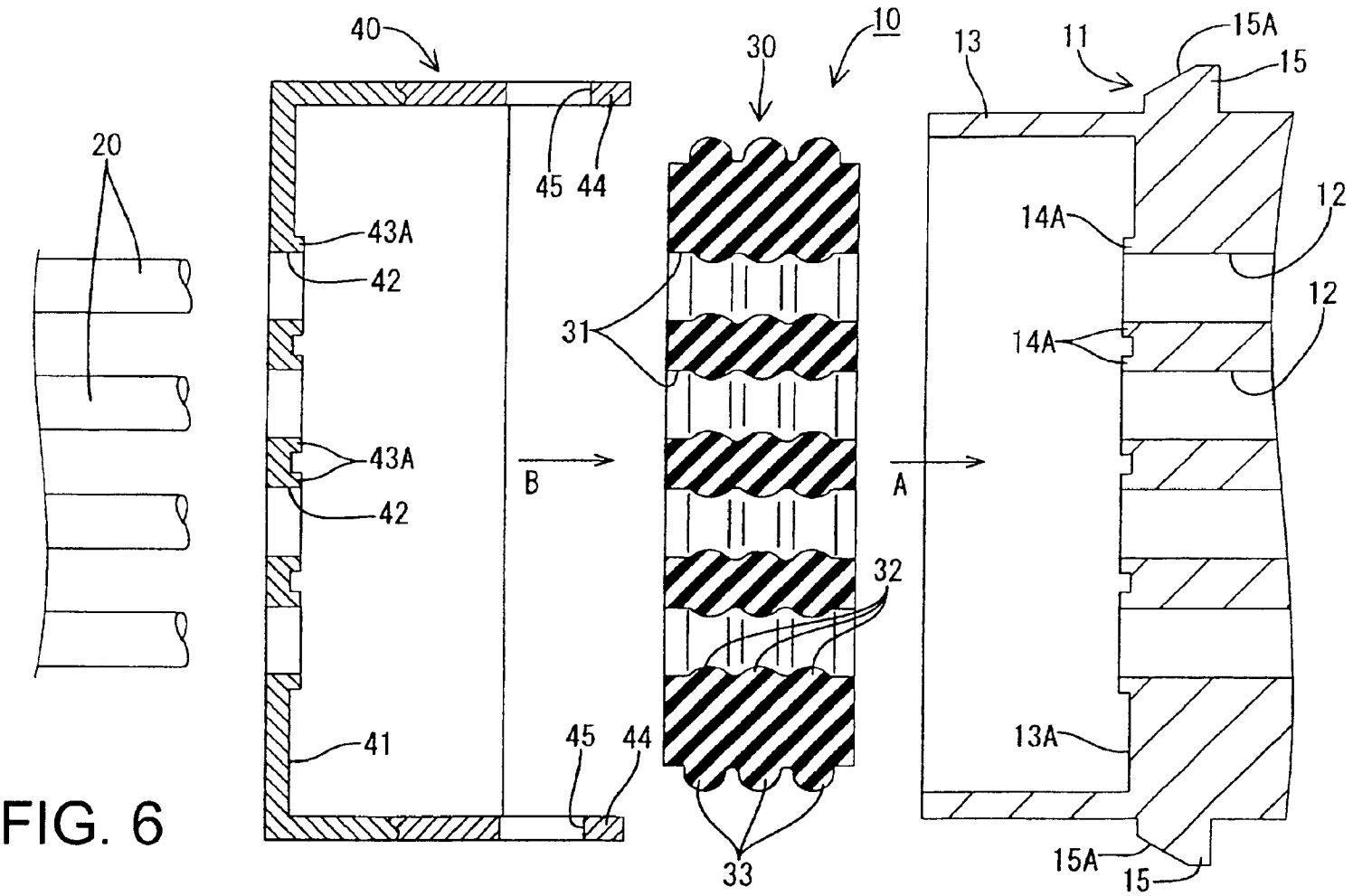
FIG. 6 is a side view partly in section before the waterproof connector is assembled.
Figure 7:
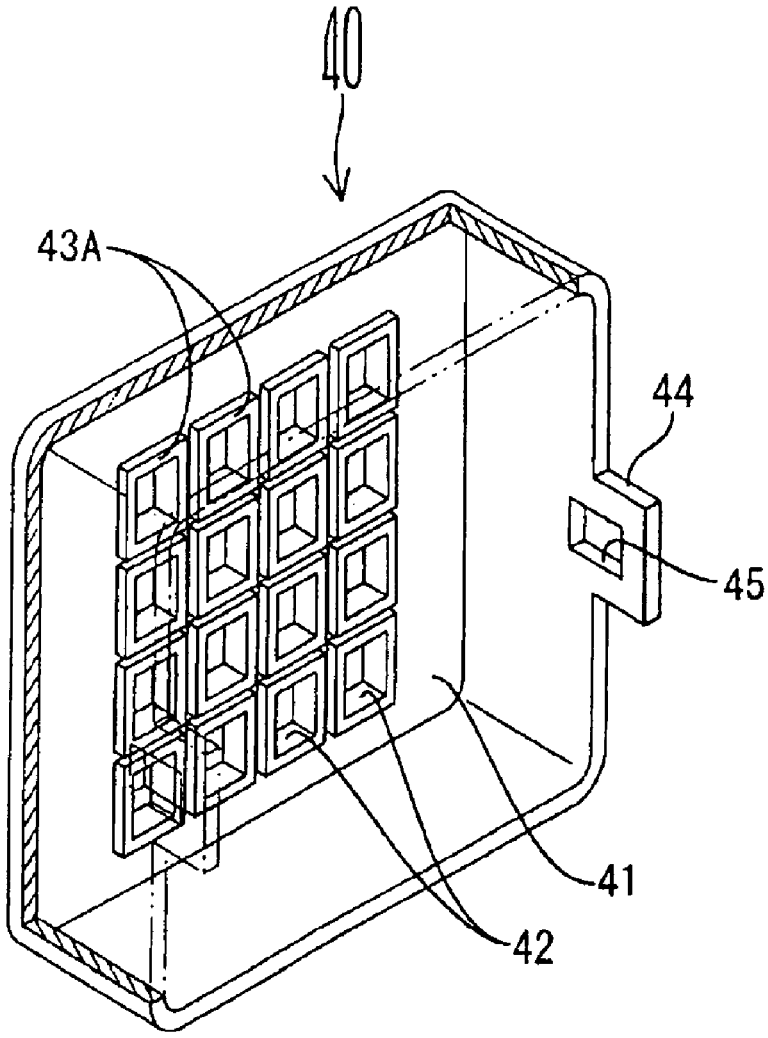
FIG. 7 is a cut-away perspective view showing a rubber plug hold-down member.
Figure 8:
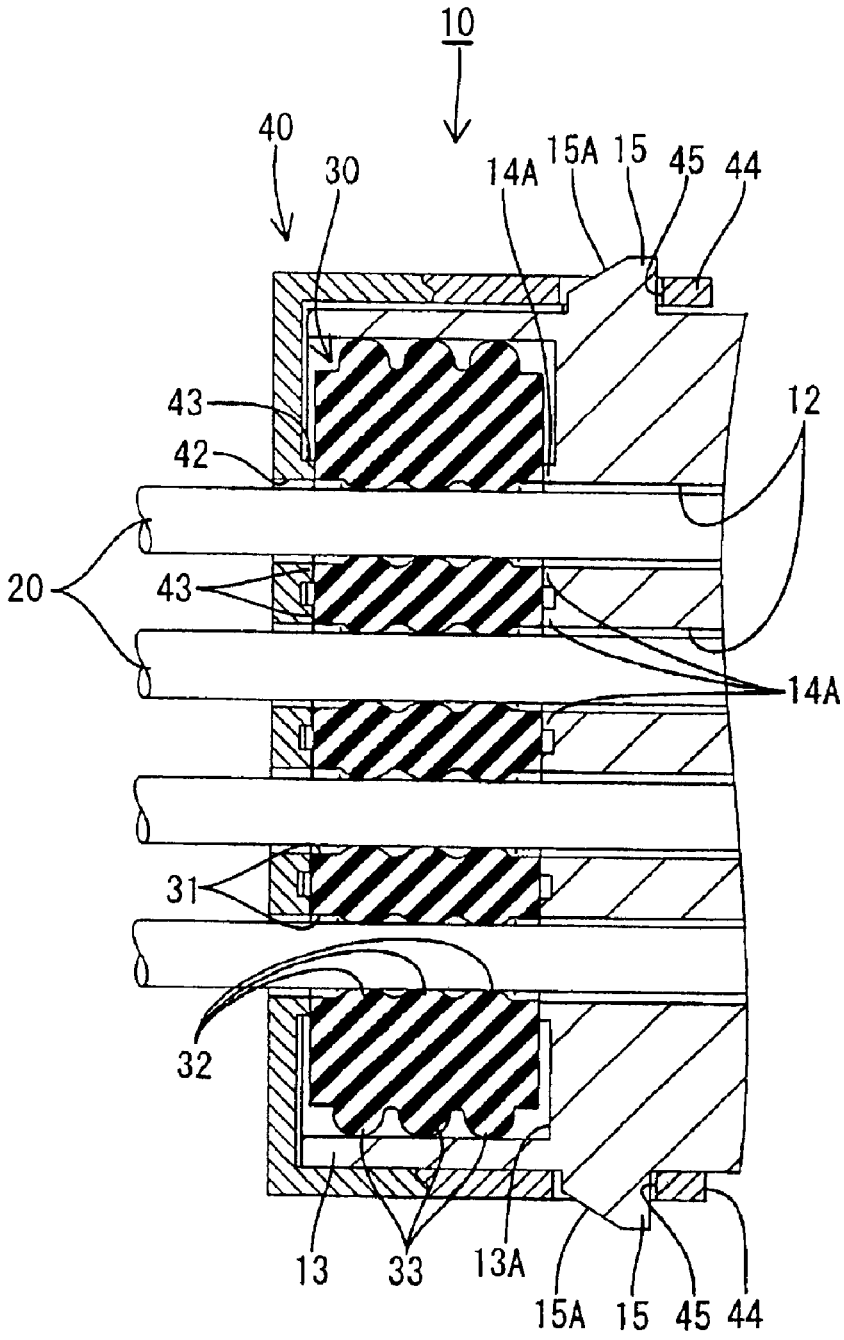
FIG. 8 is a side view partly in section showing a state in which the waterproof connector has been assembled.
Figure 9:
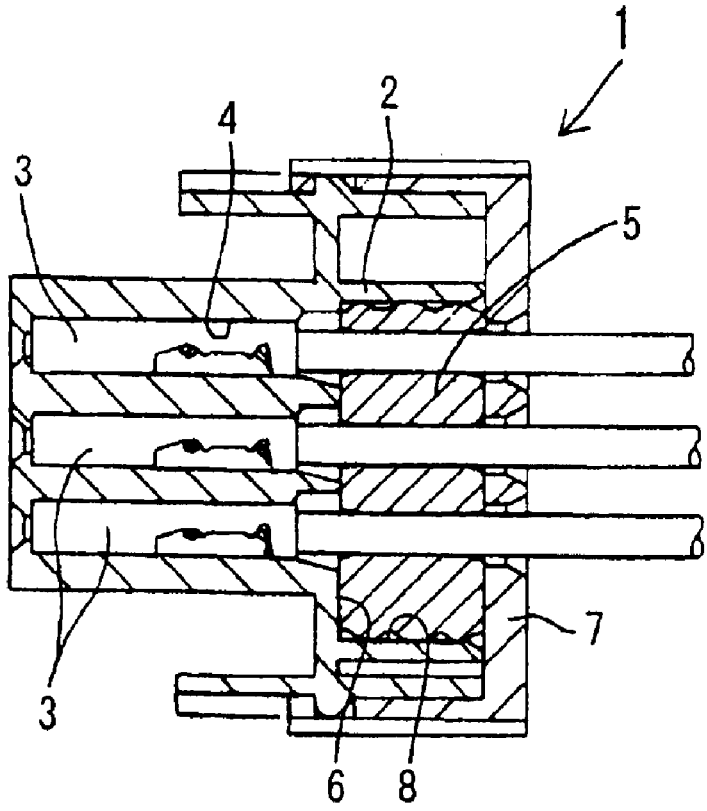
FIG. 9 is a side view partly in section showing a conventional waterproof connector.

The waterproof connector 10 shown in FIGS. 2 and 4 is box-shaped and has the connector housing 11 made of a synthetic resin. As shown in FIG. 1, cavities 12 are arranged in four steps and four rows inside the waterproof connector 11. The cavities 12 penetrate through the connector housing 11 in a front-to-back direction. Unshown terminal fittings to which electric wires 20 have been crimped respectively are inserted into the cavities 12 in a direction from the rear thereof and are accommodated in the cavities 12. When the waterproof connector 10 fits on the mating connector, the terminal fittings can be connected electrically to terminal fittings of the mating connector. A rectangular hollow rubber plug accommodation part 13 extends from the rear end of the connector housing 11 to accommodate a rubber plug 30. Rear open ends of the cavities 12 are formed on a contact surface 13A (rear surface of connector housing 11), which is the inward or front surface of the rubber plug accommodation part 13. An inner-side waterproof rib 14 projects rearward from the periphery of the contact surface 13A in such a way that the inner-side waterproof rib 14 surrounds the rear open ends of all the cavities 12 collectively. The sectional configuration of the inner-side waterproof rib 14 is rectangular in FIGS. 1, 2, and 4, but may be semicircular or triangular.

The rubber plug 30 is made of synthetic rubber and is shaped to fit suitably in the rubber plug accommodation part 13. The front surface of the rubber plug 30 is capable of contacting the contact surface 13A of the rubber plug accommodation part 13. Through-holes 31 are formed in the front-to-back direction and penetrate through the rubber plug 30 at positions corresponding to the respective cavities 12 in the connector housing 11. The terminal fittings to which electric wires 20 have been crimped respectively can be inserted into the through-holes 31 respectively. Three ring-shaped lips 32 are formed on the wall of each through-hole 31 at regular intervals in the front-to-back direction. The lips 32 contact the inserted electric wires 20 closely, thus waterproofing the gap between the electric wire 20 and the through-hole 31. Three ring-shaped seal lips 33 are formed on the entire side surface (peripheral surface) of the rubber plug 30 at regular intervals in the front-to-back direction. It is possible to waterproof the gap between the side surface or peripheral surface of the rubber plug 30 and the inner peripheral surface of the rubber plug accommodation part 13 by inserting the seal lip 33 into the rubber plug accommodation part 13, with the seal lip 33 being elastically contracted.

Figure 3:
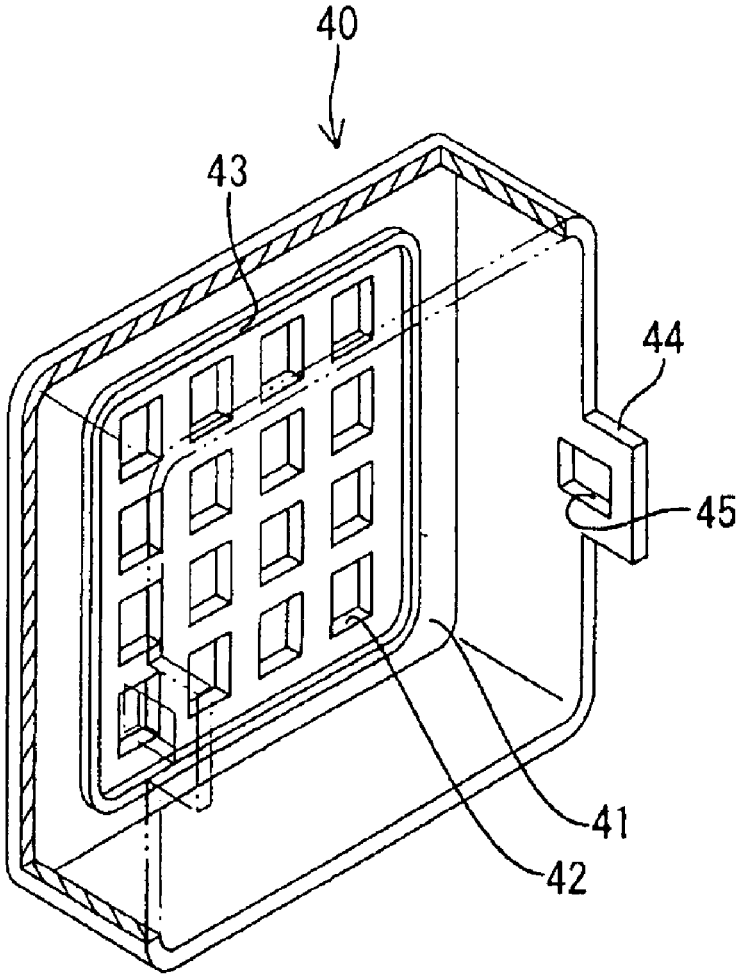
FIG. 3 is a cut-away perspective view showing a rubber plug hold-down member.

A rubber plug hold-down member 40 can be mounted in the rubber plug accommodation part 13 from the rear side thereof (see FIG. 4). As shown in FIGS. 3 and 4, the rubber plug hold-down member 40 is cap-shaped and can be fit in the rubber plug accommodation part 13 of the connector housing 11. A surface of the rubber plug hold-down member 40 confronting the rear surface of the rubber plug 30 serves as a hold-down surface 41 for the rubber plug 30. Insertion openings 42 are formed through the hold-down surface 41 at positions corresponding to each of the through-holes 31 of the rubber plug 30, and hence at positions corresponding to the cavities 12. The terminal fittings to which the electric wires 20 have been crimped respectively can be inserted into the insertion openings 42 respectively from the rear side thereof.

Outer-side waterproof ribs 43 project from the periphery of the hold-down surface 41 in such a way that the outer-side waterproof ribs 43 surround all the insertion openings 42 collectively. In this first embodiment, the outer-side waterproof rib 43 has the same size and configuration as the inner-side waterproof rib 14 and is placed at a position corresponding to the position of the inner-side waterproof rib 14 when the rubber plug hold-down member 40 is mounted on the connector housing 11.

The mounting construction of the rubber plug hold-down member 40 is described below. Two rectangular locking pieces 44 extend forward respectively from confronting front edges of an open part of the rubber plug hold-down member 40. Each locking piece 44 is deformable in an open direction. A rectangular locking opening 45 penetrates through each locking piece 44 in a direction (horizontal) in which the locking pieces 44 confront each other. Two locking projections 15 project respectively from opposite side surfaces of the connector housing 11 and can be locked to the locking openings 45 of the locking pieces 44. A tapered guide surface 15A is formed at the rear of the locking projection 15 for deforming the locking piece 44 in the open direction. The front surface of the locking projection 15 is vertical to the side surface of the connector housing 11 and serves as a locking surface for locking the locking opening 45 thereto. The hold-down surface 41 presses the rear surface of the rubber plug 30 when the locking projection 15 and the locking opening 45 are locked to each other, and in this condition, the rubber plug is pressed against the connector housing 11.

The method of assembling the waterproof connector 10 is described below. As shown with an arrow A of FIG. 2, the rubber plug 30 is pressed into the rubber plug accommodation part 13 of the connector housing 11 so that the seal lips 33 formed on the periphery of the rubber plug 30 are contracted and pressed against the inner peripheral surface of the rubber plug accommodation part 13. As a result, the gap between the side surface of the rubber plug 30 and the inner peripheral surface of the rubber plug accommodation part 13 is sealed from water (see FIG. 4). The front surface of the rubber plug 30 contacts the inner-side waterproof rib 14 of the rubber plug accommodation part 13 when the rubber plug 30 is pressed into the rear end of the rubber plug accommodation part 13. Additionally, the through-holes 31 align with the corresponding cavities 12 respectively.

The rubber plug hold-down member 40 then is mounted on the connector housing 11 from the rear side as shown by the arrow B of FIG. 2. Thus, the locking projection 15 of the connector housing 11 and the locking opening 45 formed on the locking piece 44 of the rubber plug hold-down member 40 are locked to each other. As a result, the rubber plug hold-down member 40 is locked to the connector housing 11. At this time, the rubber plug 30 is mounted on the rubber plug accommodation part 13 by means of the rubber plug hold-down member 40, with the rubber plug 30 being pressed against the rubber plug accommodation part 13.

The terminal fittings to which the electric wires 20 have been crimped then are mounted to the connector housing 11 from the rear side thereof. More particularly, the terminal fittings are inserted into the insertion openings 42 of the rubber plug hold-down member 40 and then are inserted into the through-holes 31. The terminal fittings then are inserted into the cavities 12 of the connector housing 11 (see FIG. 4). Each lip 32 inside each through-hole 31 is pressed against the cover of the corresponding electric wire 20, when the terminal fittings are mounted in the connector housing 11 in a predetermined normal state. Thus, the gap between each through-hole 31 and the corresponding electric wire 20 is waterproofed.

The waterproof seal is described below. The following three paths are conceivable as water penetration paths that should be provided with waterproof seal. In a first water penetration path, water penetrates into the insertion openings 42 of the rubber plug hold-down member 40 and reaches to the rear open ends of the cavities 12 through the through-holes 31. In a second water penetration path, water penetrates into the gap between the rubber plug hold-down member 40 and the rubber plug accommodation part 13, the gap between the inner peripheral surface of the rubber plug accommodation part 13 and the side surface or peripheral surface of the of the rubber plug 30, the gap between the front surface of the rubber plug 30 and the contact surface 13A of the rubber plug accommodation part 13, and to the rear open ends of the cavities 12. In a third water penetration path, water penetrates into the insertion openings 42, the gap between the hold-down surface 41 of the rubber plug hold-down member 40 and the rear surface of the rubber plug 30, the gap between the side surface or peripheral surface of the rubber plug 30 and the inner peripheral surface of the rubber plug accommodation part 13, the gap between the front surface of the rubber plug 30 and the contact surface 13A, and to the rear open ends of the cavities 12.

As described above, in the first water penetration path, the gap between each through-hole 31 and the corresponding electric wire 20 is sealed from water. The second and third water penetration paths also are waterproofed as follows. More particularly, the rubber plug hold-down member 40 presses the rubber plug 30 forward against the connector housing 11. As a result, the outer-side waterproof rib 43 and the inner-side waterproof rib 14 are pressed against the rubber plug 30 in such a way that the outer-side waterproof rib 43 and the inner-side waterproof rib 14 cut into the rubber plug 30. Thus, waterproofing is accomplished on the front and rear surfaces of the rubber plug 30. As described above, the gap between the side surface or peripheral surface of the rubber plug 30 and the inner peripheral surface of the rubber plug accommodation part 13 is also waterproofed.

There is a fear that in the second and third water penetration paths, a gap may form between the inner peripheral surface of the rubber plug accommodation part 13 and the seal lips 33 of the rubber plug 30 due to multi-polarization of the waterproof connector 10. However, in the first embodiment, water is sealed from penetrating into the gap between the front surface of the rubber plug 30 and the contact surface 13A of the rubber plug accommodation part 13. This gap is common to the second and third water penetration paths. Therefore, irrespective of whether waterproof seal is accomplished on the side surface or peripheral surface of the rubber plug 30, the waterproof connector 10 can be waterproofed securely. Accordingly, waterproofness of the waterproof connector 10 is accomplished reliably.

In the first embodiment, the inner-side waterproof rib 14 for waterproofing the waterproof connector 10 in the front side of the rubber plug 30 is configured to surround the rear ends of the cavities 12. Further the outer-side waterproof rib 43 for waterproofing the waterproof connector 10 in the rear side of the rubber plug 30 is configured to surround the insertion openings 42. Therefore dies for forming the connector housing 11 and the rubber plug hold-down member 40 have simple constructions and can be manufactured at a low cost. Additionally, molding of materials for the connector housing 11 and the rubber plug hold-down member 40 can be accomplished easily.

A connector according to the second embodiment of the present invention is identified by the numeral 10A in FIGS. 5 through 8.

In the second embodiment, the contact surface 13A of the rubber plug accommodation part 13 has an inner-side waterproof rib 14A formed for the rear open end of each cavity 12. Additionally, the hold-down surface 41 of the rubber plug hold-down member 40 has an outer-side waterproof rib 43A formed for each insertion opening 42 corresponding to the rear open end of the cavity 12.

Other constructions of the connector 10A of the second embodiment are similar to that of the connector 10 of the first embodiment. Parts of the second embodiment having the same function as those of the first embodiment are denoted by the same reference numerals as those of the first embodiment and description thereof is omitted herein.

In the second embodiment, the second and third water penetration paths accomplish waterproofing at the rear open end of each cavity 12 or at each insertion opening 42. That is, the inner-side waterproof rib 14A is pressed between the contact surface 13A of the rubber plug accommodation part 13 and the front surface of the rubber plug 30. Thus, it is possible to waterproof the water penetration path in the area from the rear end of the side surface or peripheral surface of the rubber plug 30 to the rear open ends of the cavities 12. This area of waterproofing is common to the second and third water penetration paths. Accordingly, waterproofing is accomplished for each cavity 12. Further for each insertion opening 42, the outer-side waterproof rib 43A cuts off the third water penetration path in the area from the insertion openings 42 of the rubber plug hold-down member 40 to the side surface or peripheral surface of the rubber plug 30.

In the second embodiment, the outer-side waterproof ribs 43A are arranged on the hold-down surface 41 of the rubber plug hold-down member 40 to surround each of the insertion openings 42 respectively. Thus, the number of the outer-side waterproof ribs 43A equals the number of the insertion openings 42 on the hold-down surface 41. The hold-down surface 41 is reinforced with the outer-side waterproof ribs 43A and thus is prevented from deforming. Therefore, it is possible to securely waterproof the gap between the rear surface of the rubber plug 30 and the hold-down surface 41.

The present invention is not limited to the embodiment described above with reference to the drawings. For example, the following embodiments are included in the technical scope of the present invention. Further, various modifications of the embodiments can be made without departing from the spirit and scope of the present invention.

In the illustrated embodiments, the inner-side waterproof ribs 14 and 14A are formed on the contact surface 13A of the rubber plug accommodation part 13, and the outer-side waterproof ribs 43 and 43A are formed on the hold-down surface 41 of the rubber plug hold-down member 40. However, the inner-side waterproof ribs 14 and 14A may be formed on the front surface of the rubber plug 30, and the outer-side waterproof ribs 43 and 43A may be formed on the rear surface of the rubber plug 30. The inner-side waterproof ribs 14 and 14A may be formed on both the contact surface 13A of the rubber plug accommodation part 13 and the front surface of the rubber plug 30. Similarly, the outer-side waterproof ribs 43 and 43A may be formed on both the rear surface of the rubber plug 30 and the front surface of the rubber plug hold-down member 40.

In the illustrated embodiments, the waterproof connector 10 has the inner-side waterproof ribs 14 and 14A and the outer-side waterproof ribs 43 and 43A. According to the present invention, the inner-side waterproof ribs 14 and 14A are formed between the front surface of the rubber plug 30 and the contact surface 13A. It is possible to prevent water from penetrating into the cavities 12 by waterproofing the gap between the front surface of the rubber plug 30 and the contact surface 13A. The gap is common to the second and third water penetration paths. Thus it is possible to construct the waterproof connector 10 so that the gap between the side surface of the peripheral surface of the rubber plug 30 and the inner peripheral surface of the rubber plug accommodation part 13 is not waterproofed.

In the illustrated embodiments, the outer-side waterproof rib 43 has the same size and configuration as those of the inner-side waterproof rib 14 and is placed at the position corresponding to the position of the inner-side waterproof rib 14. Similarly the outer-side waterproof rib 43A has the same size and configuration as those of the inner-side waterproof rib 14A and is placed at the position corresponding to the position of the inner-side waterproof rib 14A. However, the outer-side waterproof rib 43 may be different from the inner-side waterproof rib 14 in at least one of the size, configuration, and position thereof. Similarly the outer-side waterproof rib 43A may be different from the inner-side waterproof rib 14A in at least one of the size, configuration, and position thereof. For example, the inner-side waterproof ribs 14 and 14A may be shaped to surround the rear open ends of the cavities 12 collectively. Similarly the outer-side waterproof ribs 43 and 43A may be shaped to surround the insertion openings 42 respectively. Further the configuration of the inner-side waterproof ribs 14 and 14A and that of the outer-side waterproof ribs 43 and 43A may be reversed to each other.

In the illustrated embodiments, the rubber plug hold-down member 40 is formed separately from the connector housing 11 and is mounted on the rubber plug accommodation part 13. However, the rubber plug hold-down member 40 may be formed integrally with the connector housing 10. For example, the rubber plug hold-down member 40 may be formed integrally with a thin hinge, such as a living hinge, formed on the rear edge of the open portion of the rubber plug accommodation part 13. In this case, the rubber plug hold-down member 40 is mounted on the rubber plug accommodation part 13 in such a way that the rubber plug hold-down member 40 is pivotal on the hinge.

In the illustrated embodiments, each of the inner-side waterproof ribs 14 and 14A and the outer-side waterproof ribs 43 and 43A is formed as a single layer. However they be formed as at least a double layer.

In the illustrated embodiments, the electric wires 20 are inserted into the insertion openings 42 individually. However they may be inserted collectively.

In the illustrated embodiments, the cavities 12 are provided with the inner-side waterproof ribs 14 surrounding them respectively or with one inner-side waterproof rib 14 surrounding all of them collectively to waterproof the cavities 12. However, the cavities 12 may be divided into a plurality of blocks in such a way that the inner-side waterproof ribs 14 surround the blocks respectively. Thus, the inner-side waterproof ribs 14 waterproof the blocks respectively. The outer-side waterproof rib 43 may be formed similarly to the inner-side waterproof rib 14.

What is claimed is:

1. A waterproof connector, comprising:

a connector housing accommodating a plurality of cavities for receiving terminal fittings connected to ends of electric wires, the cavities having rear open ends formed on a rear surface of said connector housing;

a rubber plug having opposite front and rear surfaces that are substantially planar in an unbiased condition of said plug, through-holes extending through the rubber plug from the front surface to the rear surface at positions corresponding to said respective cavities, through which said electric wires are penetrated with said electric wires in close contact with said through-holes; and a rubber plug hold-down member having a front surface that presses said rear surface of said rubber plug for urging said rubber plug against the rear surface of said connector housing and the rubber plug hold-down member has a plurality of open portions through which said electric wires can be inserted;

wherein at least one waterproof rib projects from said rear surface of said connector housing and from the front surface of said rubber plug hold-down member so that said waterproof ribs are pressed against said front and rear surfaces of said rubber plug when said rubber plug is pressed against said rear surface of said connector housing for urging said front and rear surfaces of said rubber plug into a nonplanar configuration whereby a water penetration path passing inwards through a peripheral portion of said rubber plug is cut off before reaching said rear open ends of said cavities.

2. The waterproof connector of claim 1, wherein said waterproof rib surrounds a region corresponding to said rear open ends of said cavities collectively.

3. The waterproof connector of claim 1, wherein said at least one waterproof rib comprises a plurality of waterproof ribs surrounding regions corresponding respectively to said rear open ends.

4. The waterproof connector of claim 1, wherein said rear open ends of said cavities are formed in a rubber plug accommodation part capable of accommodating said rubber plug; and seal lips capable of water-tightly contacting an inner peripheral surface of said rubber plug accommodation part are formed on a peripheral surface of said rubber plug.

5. A waterproof connector, comprising:

a connector housing with opposite front and rear ends and a plurality of cavities extending through the connector housing, such that each said cavity has an open rear end at the rear end of said connector housing;

a rubber plug having opposite front and rear surfaces, the front and rear surfaces being substantially planar in an unbiased condition of the rubber plug, the front surface of the rubber plug being mounted to the rear end of the connector housing, the rubber plug having through-holes at positions corresponding to said respective cavities; and a rubber plug hold-down member mounted to the connector housing and having a front surface that presses said rubber plug against the rear end of said connector housing, the rubber plug hold-down member having a plurality of open portions aligned respectively with the through-holes of the rubber plug;

wherein at least one waterproof rib projects from said rear end of said connector housing so that said waterproof rib is pressed against said front surface of said rubber plug when said rubber plug is pressed against said rear surface of said connector housing, so that the front surface is biased into a nonplanar condition by the waterproof rib for secure sealing around the cavities.

6. The waterproof connector of claim 5, wherein said waterproof rib surrounds a region corresponding to all of said open rear ends.

7. The waterproof connector of claim 5, wherein the at least one waterproof rib comprises a plurality of waterproof ribs surrounding regions corresponding respectively to said open rear ends.

* * * * *